United States Patent [19]

Meeker

[11] 4,188,065

[45] Feb. 12, 1980

[54] COMBINATION HARNESS AND COVERLET FOR INFANT SEATS

[76] Inventor: Marlene F. Meeker, 804 Meade Dr., Greensboro, N.C. 27410

[21] Appl. No.: 929,451

[22] Filed: Jul. 31, 1978

[51] Int. Cl.[2] ..... A47C 31/00; A47C 27/00

[52] U.S. Cl. ..... 297/485; 297/219; 128/134; 297/466; 297/441

[58] Field of Search ..... 5/336, 334, 335, 343; 2/114; 297/223, 221, 219, 384, 385, 389, 441

[56] References Cited

U.S. PATENT DOCUMENTS

| | | | |
|---|---|---|---|
| 1,602,941 | 10/1926 | Rosman | 5/336 X |
| 2,463,049 | 3/1949 | Onsa | 297/385 X |
| 2,495,482 | 1/1950 | Rogatz | 297/441 X |
| 2,635,245 | 4/1953 | Nigro | 297/385 X |
| 2,713,890 | 7/1955 | Mack | 297/441 X |
| 2,716,239 | 8/1955 | Barndollar | 5/334 R |
| 2,980,169 | 4/1961 | Campbell | 5/334 X |
| 3,136,581 | 6/1964 | Caballero | 297/384 |
| 3,181,530 | 5/1965 | Storey | 128/134 |
| 3,222,108 | 12/1965 | Pablos | 297/441 |
| 3,235,306 | 2/1966 | Cherniusky | 297/441 X |
| 3,431,020 | 3/1969 | Tyndall | 297/378 |
| 3,934,934 | 1/1976 | Farrell et al. | 297/384 |
| 3,968,911 | 7/1976 | Haas | 5/336 |

*Primary Examiner*—James T. McCall
*Attorney, Agent, or Firm*—Charles R. Rhodes

[57] ABSTRACT

A combination comfort pad, restraining harness, and coverlet is so constructed as to be attachable to an existing infant seat. The pad section has a moisture-proof innerlining which overlies the back and seat portions of the infant seat. The harness is spaced above the surface of the pad section and has a base portion and a pair of midriff straps separated from the base portion by notched areas. The midriff straps are of an adjustable length sufficient to wrap around the infant and the infant seat to fasten together thereunder. At least one and preferably two coverlets, of varying weights, are attached to the lower end of the pad. When one or both of the coverlets are not in use they are tucked away to the underside of the infant seat.

3 Claims, 3 Drawing Figures

COMBINATION HARNESS AND COVERLET FOR INFANT SEATS

BACKGROUND OF THE INVENTION

The use of infant seats to support infants during travel, feeding or other periods has become increasingly popular. The seats provide a secure, supportive surrounding which allows the infant to remain comfortable therein for extended periods if necessary.

Although the infant seats themselves have undergone considerable design changes for comfort and safety, the restraining straps or harness used thereon pose many problems. The straps are conventionally designed so that one fits across the infant's midriff and another across the straddle area. The straps are primarily of a rather narrow dimension, fastened with buckles which may be irritating to a young child if fastened too tightly.

Further problems with the infant seats include inadequate padding in the back and seat areas, and difficulties involved in utilizing a blanket or coverlet over the child when desired and where the harness is used.

SUMMARY OF THE PRESENT INVENTION

The present invention is directed to the unitary construction of an accessory for an infant seat which includes a comfort pad, a restraining harness and a coverlet.

The pad section is generally of a rectangular shape, of a dimension such that it will overlay the back and seat area of the infant seat, and may include a moistureproof innerlining.

Attached to the front and lower portion of the pad, by machine stitching or other means, is the restraining harness. The harness includes a pair of midriff straps extending from opposite sides of the top portion thereof. The top portion extends across the infant's midriff and the straps around the seat to snap or otherwise fasten securely. Just under the strap section of the harness, opposing notches are cut out of the midsection such that the legs of the infant may extend freely therethrough.

Finally and also attached to the lower edge portion of the pad and harness portion, at least one blanket or coverlet section is provided for protecting the infant from chill or other weather conditions. In a preferred embodiment two coverlets are provided. A first is of a lightweight material for minimum coverage, and a second is of a heavier material for protection against colder temperatures. When not in use the heavier blanket, or both if desired, may be tucked away under the skirt segment of the infant seat.

The accessory as a whole is attached to the infant seat by two relatively deep pocket members, one on each end of the underside of the pad, which pocket members slip over the opposite ends of the infant seat and by auxiliary side straps which snap into place on the side walls of the seat.

Construction material for the accessory generally includes any washable fabric having a somewhat absorbent nature and a relatively soft hand so that there is no irritation to the skin. Such fabrics would include soft cottons and terrycloth. The aforementioned optional moistureproof inner liner may be any flexible material such as lightweight rubber sheeting, plastic sheeting, etc. and is removably inserted between the inner and outer layers of the primary fabric.

In use the accessory is placed on the infant seat such that the pad overlies the back and seat portions with the ends of the seat inserted in the pockets. After the child is placed therein, the harness section is placed over the child, legs protruding through the notches, midriff strap in place and wrapped around to the underside of the seat and securely fastened. The blanket(s) may be tucked away in the rear pocket behind the seat or one or both may be pulled up to cover the infant. The pad will provide a comfortable absorbent surface for the infant. The generally enlarged harness straps will provide support adequate to maintain the infant in a comfortable, safe position without binding or cutting, and no metal buckles or parts can contact the infant's body.

Therefore the objects of the present invention include:

1. The provision of a restraining/coverlet accessory for an existing infant seat which will significantly increase the degree of safety and comfort of an infant placed therein;
2. The provision of a harness device for use on an infant seat to maintain an infant in a safe position without the use of narrow, stiff straps and/or metal buckles;
3. The provision of a blanket or coverlet which is easily maintained in position over an infant seated in an infant seat beneath a restraining harness.

Other and further objects of the present invention will become apparent to those skilled in the art as the following detailed description is studied in conjunction with the accompanying drawings of which:

DETAILED DESCRIPTION OF A PREFERRED EMBODIMENT

Figure 1:
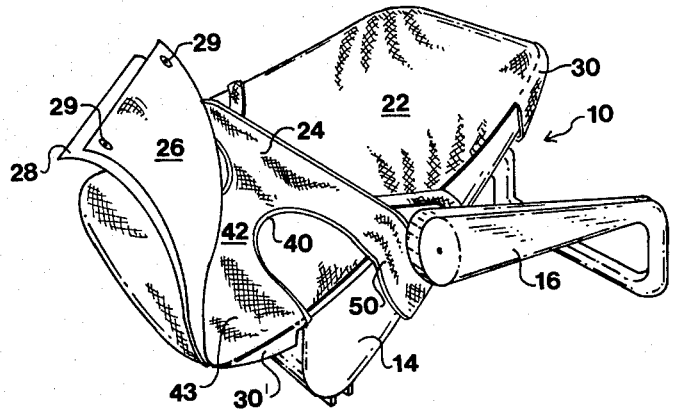
FIG. 1 is an evironmental perspective view of an infant seat having a restraining accessory according to the present invention attached thereto.

FIG. 1 illustrates a conventional infant seat 10 including the harness accessory 20 of the present invention. The infant seat 10 includes a back portion 12, a seat 14, a lower skirt 15, and an adjustable support 16. One such infant seat is described in U.S. Pat. No. 3,409,325 and because they are well known further discussion will not be made herein.

The harness accessory 20 is shown as preferred to include a comfort pad 22, a harness 24, a first blanket or coverlet 26, a second blanket or coverlet 28, and two under pockets 30,30' which are slipped onto the upper and lower portions of the infant seat to hold the accessory thereon.

Figure 2:
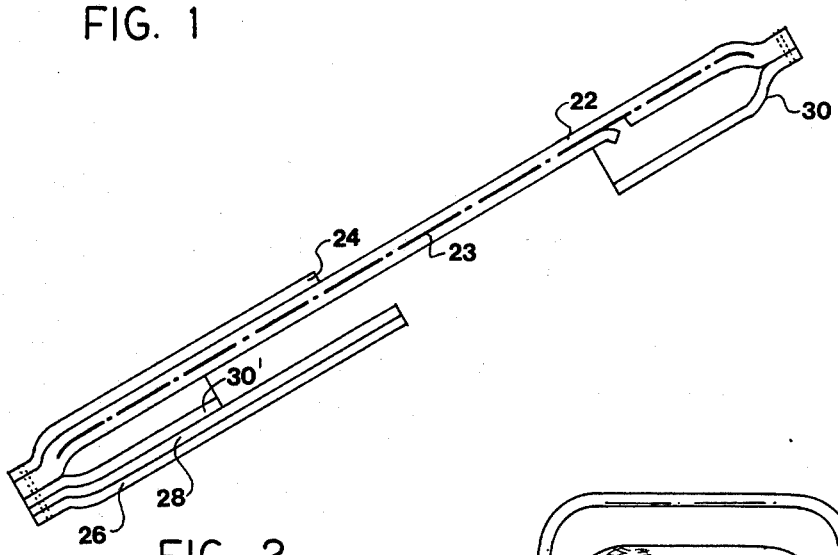
FIG. 2 is a cross-sectional view of the invention (removed from the infant seat) taken substantially along the lines 1—1 of FIG. 1.

Specifically, the safety accessory 20 comprises a unitary construction having individual sections machine-stitched together in a relationship to each other that is best illustrated in FIG. 2. There it can be seen that the pad section 22 furnishes the primary body for the accessory and all the other segments depend therefrom. As illustrated pad 22 is constructed such that it may include an optional moistureproof layer of material (represented as broken line 23) removably inserted between the pad 22 and the pockets 30,30'. The dimensions of the pad should be such that it will substantially cover the back 12 and seat 14 sections of the infant seat to impart a cushioning effect and moisture absorbency which will make the infant more comfortable therein.

To hold the pad and accessory in position, two opposing pocket forming members 30,30' are stitched to the underside of the pad at the upper and lower ends thereof. The upper member 30 slips down over the top of the infant seat back 12 and the lower pocket forming member 30' slips upwardly over the skirt portion 18 of the infant seat.

Figure 3:
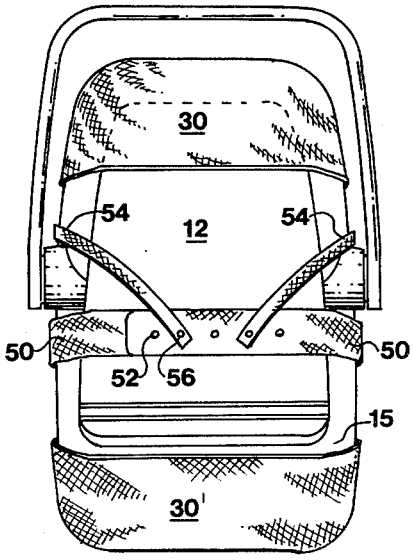
FIG. 3 is a plan view of the underside of an existing infant seat with the harness accessory according to the embodiment of FIG. 1 in place thereon.

The harness section 24 includes a lower base portion 43 stitched around the edges to the peripheral portion of the lower end of the pad, and a pair of midriff straps 50 adjacent the top thereof which wrap across the midriff section of the infant and extend around the underside of the seat where they are fastened together. FIG. 3 illustrates the straps 50 in place and preferably fastened by a series of heavy duty snap fasteners 52. The snaps 52 are attached at horizontally spaced points along the straps 50 so that the straps may be adjusted to accommodate the growth of the child. To maintain the midriff straps 50 in position, a side strap 54 is attached at one end to the upper edge of each midriff strap 50. These straps 54 extend upwardly from the midriff, over the hub of the seat support 16, and around to the underside of the seat where they fasten by snaps 56 to the upper surface of midriff strap 50. When the midriff and side straps are all properly positioned and fastened the harness 24 will remain snug around the infant's midriff in a safe, comfortable position.

Notched areas 40 formed intermediate the midriff straps 50 and the lower base portion 43 of the harness provide for the free movement of the infant's legs. Between the notches 40 the straddle section 42 supports the infant to prevent a downward slipping. The straddle 42 is sufficiently wide to support the infant without binding or cutting as occurs with previously known straps which are narrow and stiff.

To protect the infant from cold or other weather conditions, coverlets 26 and 28 are stitched to the undersurface of pad 22 as illustrated in FIG. 2. When a light covering is desired the first coverlet 26 may be pulled up over the child as shown in FIG. 1. The second coverlet 28 remains tucked up under the skirt portion of the seat behind the pocket member 30. If heavier covering is desired the second coverlet 28 is pulled up over the infant. The second coverlet 28 is generally preferred to be of a heavier weight than first coverlet 26, utilizing a double thickness of the primary fabric or any material of substantial weight to protect from cold. Both coverlets are held in place by snaps 29 in the upper corners which mate to snaps on the upper surface of the midriff straps 50. As previously stated, the coverlets may both be tucked to the underside of the infant seat when not in use.

It is obvious that modifications may be made to the above-described invention, including variations in fabric, fastening means and design all within the scope of the invention as claimed below.

What is claimed is:

1. An accessory for existing infant seats of the type having a back portion, a seat portion, and a skirt portion, said accessory comprising a single unit construction including:

(a) a pad having upper and lower ends and overall dimensions such that said upper end substantially overlies the back portion, and said lower end substantially overlies said skirt portion of the infant seat;

(b) a restraining harness overlying the lower end of said pad and including:

(i) a base portion and an upper portion said base portion being secured and its side and bottom edges to the corresponding peripheral portion of said lower end of said pad;

(ii) a pair of midriff straps extending from opposite sides of said upper portion around opposite sides of the seat;

(iii) means for fastening the opposite ends of said midriff straps; and (iv) a pair of notched areas separating the base portion of said harness from said midriff straps through which an infant's legs extend and forming a straddle area between said notched areas and joining the upper portion and base portion;

(c) at least one coverlet attached to the lower end of said pad and harness assembly of subparagraphs (a) and (b); and (d) means for removably attaching said pad to said infant seat.

2. An accessory for infant seats as described in claim 1 and further including a moistureproof innerlining within said pad.

3. An accessory for infant seats as described in claim 1 wherein said means for removably attaching said accessory to the infant seat includes a first pocket member attached to the upper end on the underside of said pad and a second pocket member attached to the lower end on the underside of said pad with the open edges of each of said pockets facing inwardly toward the vertical mid-point of said pad.

* * * * *